US010870250B2

(12) United States Patent
Ulm

(10) Patent No.: US 10,870,250 B2
(45) Date of Patent: Dec. 22, 2020

(54) DEVICE FOR DEWATERING FEEDSTOCK THAT IS POURABLE OR FREE-FLOWING

(71) Applicant: Andritz AG, Graz (AT)

(72) Inventor: Dietmar Ulm, Breitenfurt (AT)

(73) Assignee: Andritz AG, Graz (AT)

( * ) Notice: Subject to any disclaimer, the term of this patent is extended or adjusted under 35 U.S.C. 154(b) by 400 days.

(21) Appl. No.: 15/822,622

(22) Filed: Nov. 27, 2017

(65) Prior Publication Data

US 2018/0154599 A1 Jun. 7, 2018

(30) Foreign Application Priority Data

Dec. 2, 2016 (AT) ..... 51097/2016

(51) Int. Cl.
*B30B 9/12* (2006.01)
*B30B 9/26* (2006.01)

(52) U.S. Cl.
CPC ..... *B30B 9/124* (2013.01); *B30B 9/26* (2013.01)

(58) Field of Classification Search
CPC ..... B30B 9/124; B30B 9/26; B30B 9/262; B30B 9/267; B30B 9/12; B30B 9/14; B30B 9/16
USPC ..... 100/110, 126, 127, 117
See application file for complete search history.

(56) References Cited

U.S. PATENT DOCUMENTS 2,320,765 A * 6/1943 Upton ..... B30B 9/26 100/339
2,800,072 A * 7/1957 Vandenburgh ..... B30B 9/26 100/127
3,093,065 A * 6/1963 French ..... B30B 9/26 100/127
3,191,521 A * 6/1965 Hiller ..... B30B 9/12 100/37
3,982,483 A * 9/1976 Bird ..... B30B 9/121 100/117
4,150,617 A * 4/1979 Schramm ..... B30B 9/26 100/117
4,297,943 A * 11/1981 Laurich-Trost ..... B30B 9/26 100/129
5,566,611 A * 10/1996 Scheucher ..... B30B 9/121 100/127
5,665,232 A * 9/1997 Schlegel ..... B30B 9/12 100/117
8,333,282 B2 12/2012 Pallmann
2013/0199383 A1* 8/2013 Horton ..... B30B 9/121 100/37

* cited by examiner

*Primary Examiner* — Jimmy T Nguyen
(74) *Attorney, Agent, or Firm* — Alix, Yale & Ristas, LLP

(57) ABSTRACT

A device for dewatering feedstock that is pourable or free-flowing by compression and segments for use with such a device. A housing has a shell pipe in which a shaft with flights running around its circumference rotates around an axis of rotation. A feedstock is transported through the housing and compressed. The pressate is conveyed out of the device through holes in the shell pipe. An internal pipe is provided within the shell pip. The internal pipe has numerous segments with holes. The outer surface of the segments rests directly on the inner surface of the shell pipe. The holes in the segments overlay the holes in the shell pipe. The segments are made of wear-resistant cast or sintered material.

20 Claims, 5 Drawing Sheets

DEVICE FOR DEWATERING FEEDSTOCK THAT IS POURABLE OR FREE-FLOWING

CROSS-REFERENCE TO RELATED APPLICATION

This application claims priority from Austrian Patent Application No. A51097/2016, filed Dec. 2, 2016, the entire content of which is hereby incorporated by reference.

BACKGROUND

The invention relates to a device for dewatering feedstock that is pourable or free-flowing, for example wood chips, by compressing it, comprising a housing with a shell pipe in which a shaft with flights running around its circumference rotates round an axis of rotation, where the feedstock is transported through the housing and compressed and the pressate is conveyed out of the device through holes in the shell pipe, and where an internal pipe is provided.

Devices of this kind are known, for example from DE 20 2007 007 038 U1, where these devices usually have a feed unit, in the form of a chute for example. Special designs serve to feed wood chips into a pulp digester in the chemical pulp industry and are often also referred to as plug screw feeders in this context. There are also applications as feed units to digesters in the mechanical pulp industry. In general, a material is conveyed from an area under low pressure to an area under higher pressure or vice versa. These devices are thus also used as an air lock. In addition to squeezing out the pressate (effluent), which is usually water possibly containing chemicals if required, compression of the material serves in addition to create a densely compacted plug of the material that seals off the inlet towards the pressurized system of a digester. A highly compacted material plug that absorbs impregnating chemicals, in this case when the pressure is relieved, is also produced in other devices, such as MSDs. In devices of this kind, there is a lot of wear both on the screw flighting and on the shell pipe due to high compacting of the feedstock, resulting in high pressing forces on the inside of the screw shell, so that devices of this kind have to be refurbished or reinforced at regular intervals. This involves considerable costs and longer shutdowns in production. The worn housings are often refurbished by applying hard-facing and then machining them. The disadvantage of this hard-facing method is that the workpiece becomes warped and also shrinks during welding and can no longer be positioned precisely inside the shell pipe as a result. The residual stress as a consequence of applying heat during welding can lead to cracks forming and, as a further consequence, to component failure. Refurbishment is expensive and time-consuming, and the component has to be brought to a workshop for refurbishing. As an alternative, so-called wear shells can be inserted, which can then be replaced. These are cylinder half sections made of wear-resistant material, which are fitted into the shell pipe after it is dismantled and thus form an internal pipe. These are very difficult to manufacture, and there are frequent problems with the fit. Wear shells of this kind are usually also more expensive than refurbishment by hard-facing.

SUMMARY

The aim of the invention is to disclose a device that is significantly cheaper and avoids the disadvantages mentioned above.

The invention is thus characterized in that the internal pipe is built up from segments with holes, where the outer surface of the segments rests directly on the inner surface of the shell pipe and the holes in the segments overlay the holes in the shell pipe, where the holes in the segments have a smaller cross-section than the holes in the shell pipe, and each hole in the segments is assigned to a hole in the shell pipe and where the segments are made of wear-resistant cast or sintered material.

Due to the structure of the internal pipe made of segments, the parts to be replaced are smaller and can be transported more easily. As the segments rest directly on the inner surface of the shell pipe, these parts are supported over their entire area and can thus be manufactured with very low wall thicknesses. In addition, the shell pipe and the segments can be made of different materials, allowing the shell pipe to absorb the forces and the segments to be made of a hard, brittle, and thus wear-resistant material. As they are designed as cast or sintered parts, the segments can be left unmachined for the most part. Thus, there is no need for costly machining of large areas on the outer or the inner surface. In addition, the holes can be cast in the part itself so there is no need for subsequent, labour-intensive drilling, particularly metal-cutting drilling. As a result, it is also possible to use harder materials that cannot be machined. Optimum dewatering is achieved because the holes in the segments match up with the holes in the shell pipe.

A favourable embodiment of the invention is characterized in that the shell pipe is cylindrical, but can be conical as an alternative. In this way, the device can be adapted easily to the production needs and to the screw required for this purpose.

A favourable development of the invention is characterized in that the internal pipe comprises at least 4, preferably 6-8 segments in circumferential direction. As a result, areas that are less worn can be left in place and only areas with more wear need to be replaced.

An advantageous embodiment of the invention is characterized in that the internal pipe comprises at least 2, preferably 3-4 and up to 6 segments in longitudinal direction in accordance with the direction of the axis of rotation. This makes installation much easier on the one hand, and on the other hand, the areas with less wear can be left as they are and only areas with more wear, particularly at the end where there is considerable compaction, need to be replaced.

A favourable development of the invention is characterized by the holes in the segments becoming wider conically towards the outer surface. As a result, any plugging of the holes can largely be avoided.

Another favourable embodiment of the invention is characterized in that the segments each have a groove in longitudinal direction. These grooves can be used in particular to prevent the feed material from rotating together with the shaft and flighting.

An alternative embodiment of the invention is characterized in that the segments each have, in particular, an integrated strip in longitudinal direction. These strips can also be used to prevent the feed material from rotating together with the shaft and flighting.

The invention also relates to a segment of an internal pipe for a device to dewater feedstock that is pourable or free-flowing, for example wood chips, with a housing with a shell pipe with holes and in which the internal pipe is provided. It is characterized in that the segment is made of wear-resistant cast or sintered material, where holes are provided with a smaller cross-section than the holes in the shell pipe, where the holes become wider conically towards the outer surface. In particular, the design with cast or sintered material enables low-cost manufacture and dispenses with the need for further machining. As a result, the dewatering holes can be cast together with the part so there is no need for labour-intensive drilling.

BRIEF DESCRIPTION OF THE DRAWINGS

The invention will be described with reference to the drawings, where.

DETAILED DESCRIPTION

Figure 1:
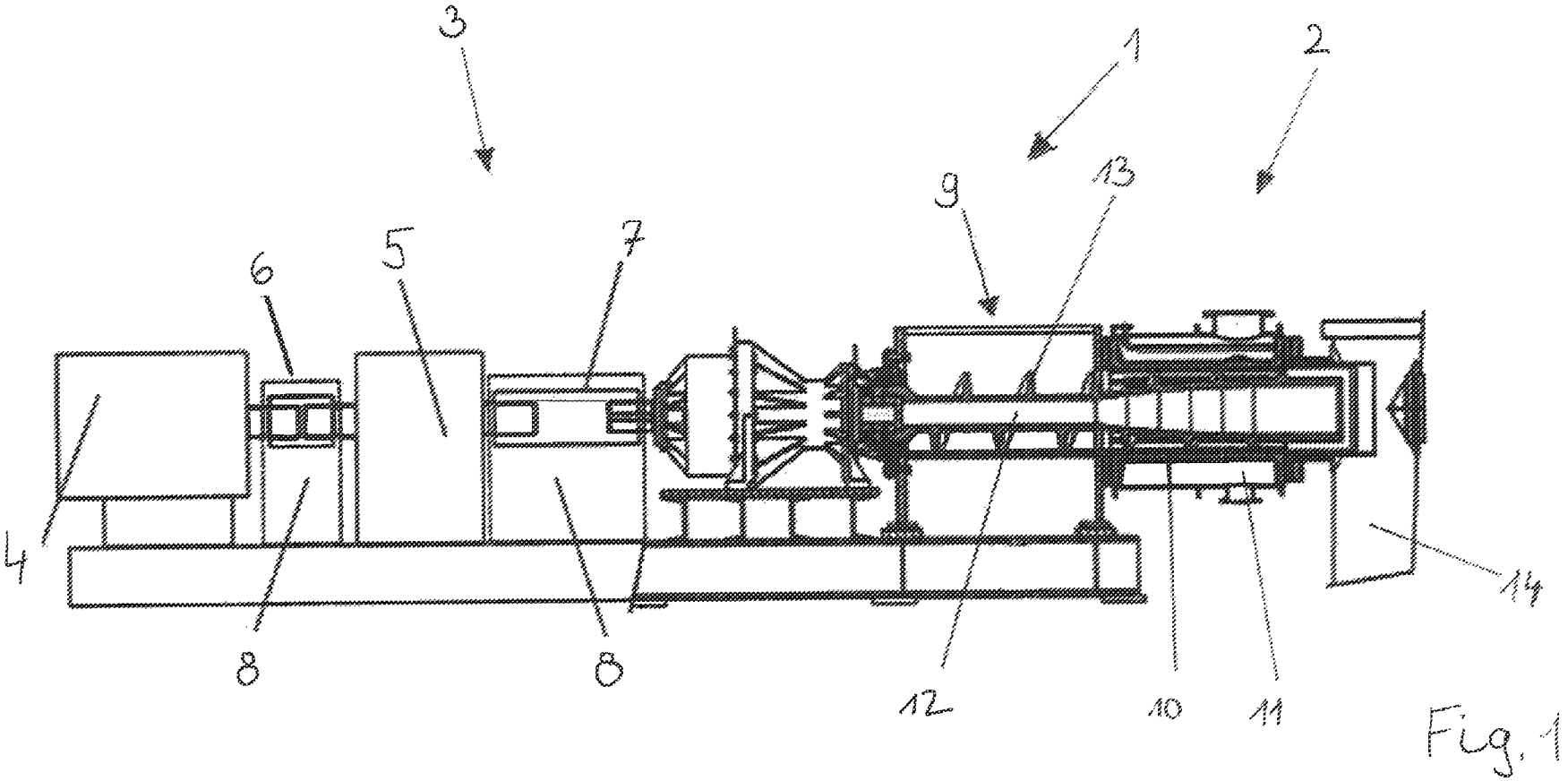
FIG. 1 shows the basic structure of a generic dewatering device.

FIG. 1 shows a dewatering device 1 with a plug screw feeder 2 and drive 3, as generally known in the art. The drive 3 has a drive motor 4, a gearbox 5, a coupling 6 (for example a high-speed coupling), another coupling 7 (for example a low-speed coupling), and safety devices 8. The plug screw feeder 2 comprises a feed chute 9, the housing 10 with a discharge chamber 11, as well as the screw 12 with flights 13. The housing 10 can be cylindrical as shown, but may also be tapered conically. The housing 10 of the plug screw feeder 2 is mounted on a vessel 14, which can be a pulp digester if the device is used in the chemical pulp industry, where the vessel generally has a different pressure stage, but the materials can also have a different physical state. The plug screw feeder then acts here as an air lock. The material placed in the feed chute, e.g. wood chips, but also annual plants, straw, bagasse, or similar, is carried by the flights 13 of the screw 12 into the housing 10 and pressed through it, during which process liquid, mainly water that may be mixed with chemicals, flows into the discharge chamber 11 and is discharged from there and fed to a recycling unit if necessary. A highly compacted material plug that absorbs impregnating chemicals, in this case when the pressure is relieved, is also produced in other devices, such as MSDs. Due to the high degree of compression of the feed material, extensive wear occurs on the inside of the housing 10 so these housings must be refurbished or reinforced frequently. One possibility is to dismantle the housing and have it brought to a workshop for hard-facing and then machining so that it is ready for operation again. As a result, the plant operator cannot use this component for a longer period, not even as a spare part for emergencies. Replaceable wear shells can be used as an alternative. However, they must be manufactured with high precision, and there are often problems with the fit.

Figure 2:
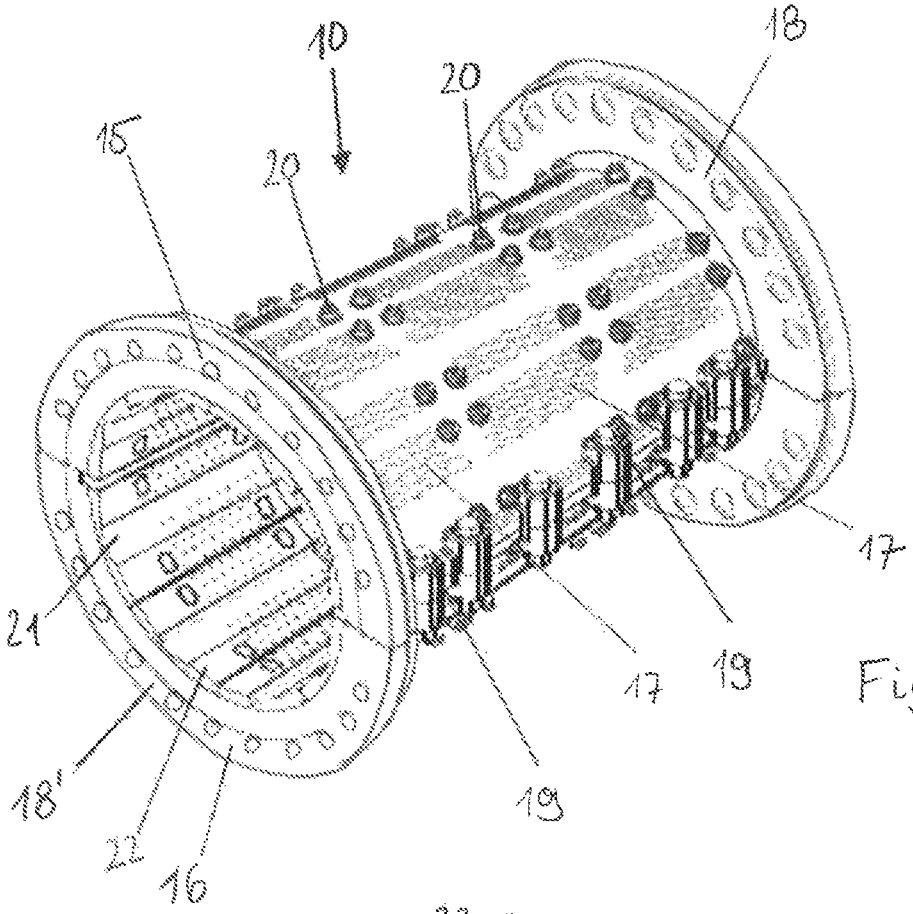
FIG. 2 shows the housing of a device disclosed herein with internal pipe.

FIG. 2 shows a housing 10 according to the disclosure, which comprises a top half shell 15 and a bottom half shell 16. These shells have dewatering holes 17, which can be arranged in groups as shown. The half shells 15, 16 each have flanges 18 and 18', respectively, at the ends with which the housing is mounted on the feed chute 9 at one side and the vessel 14 at the other side. The two half shells 15, 16 are held together with a number of screws 19. Segments 21, 22 are arranged inside the half shells 15, 16. More screws 20 are used to secure these segments 21, 22 to the housing 10. All of the segments 21, 22 together form an internal pipe inside the housing 10. Here there are six segments 21, 22 shown distributed around the circumference. However, there may also be fewer or more segments distributed round the circumference, depending on the diameter of the housing 10. Here, the outer surface of the segments 21, 22 rests directly, i.e. without any gap, on the inner surface of the half shells 15, 16 of the housing 10.

Figure 3:
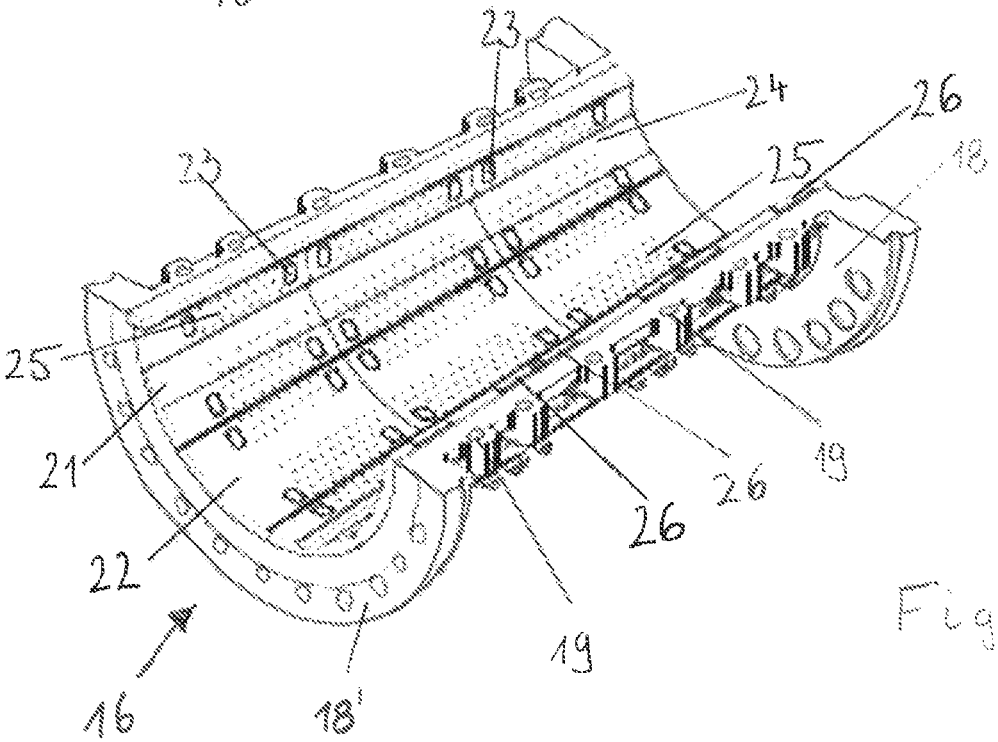
FIG. 3 shows a half shell from the device of the disclosure.

FIG. 3 shows the bottom half shell 16. It has flanges 18, 18' at the ends. The individual segments 21, 22 have holes 23 so that they can be secured with screws 20. It is visible from the figure that different segments can be used here. The segments 21 have a groove 24 running along their length, which serves to prevent materials from rotating together with the shaft and flighting. In addition to segments 21, there are also segments 22 that do not have a groove. The number of segments 21 with a groove 24 and segments 22 is selected on the basis of the dewatering behaviour, but also in view of the caking and thus the entrainment properties of the feed material. The use of segments 21 and 22, respectively, thus provides a means of adjusting dewatering and entrainment of the feed material. As an alternative to segments with a groove, it is also possible to insert segments 22' (see FIG. 7) with strips in order to prevent entrainment of the feed material. Three segments 21 and 22, respectively, in a row are shown in longitudinal direction of the housing 10. Depending on the length of the housing 10, it would of course be possible to arrange several segments 21, 22 in longitudinal direction, i.e. in axial direction of the screw. It is important that the holes 25 in the segments 21, 22 match up directly with the holes 17 in the half shells 15, 16, i.e. each hole 25 in a segment 21, 22 is assigned to a hole 17 in a half shell 15, 16 of the housing 10. This is achieved by securing with screws 20, among other things. The screws 20 are inserted from the inside, i.e. from inside the cylinder formed by the segments 21, 22, and secured on the outside with nuts. Thus, there is no need for any threads in the segments 21, 22, nor in the half shell 15, 16 of the housing 10. As a result, much harder materials can be used for the segments 21, 22 because no machining is necessary. The screws 20 can have a spherical cap in longitudinal direction, for example, so that they are always in the correct position in the correspondingly shaped holes 23. The screws 20 can also have indentations such as slots, for example, at the inner (cylinder) surface of the segments 21, 22, which then form a flat surface due to wear on the segments and on the raised part of the screw heads and, as such, can be used as wear indicators that show when the segments 21, 22 need to be replaced. Segments 21 and 22 are cast from wear-resistant material, thus all holes 25 can be formed easily without requiring any subsequent machining. The holes 25 here can also be formed in a conical shape very easily and need not be step-drilled, which would require frequent tool changes during manufacture. Alternatively, the segments can also be sintered from wear-resistant material, which also offers the opportunity to form the holes 25 easily right away in one process. The design of the segments 21, 22 as cast or sintered parts means that substantially harder materials can be used that no longer require machining with normal cutting tools, such as drills.

In order to be able to save on further machining, only the contact surfaces 26 on the longitudinal sides of the segment 21, 22 edges close to the ends of the segments 21, 22 have to be machined lightly in order to guarantee that the individual segments 21, 22 are positioned exactly. As several segments 21, 22 are arranged in longitudinal direction, it is also possible only to replace the segments with the most wear. With this type of inner lining in the housing, repairs can be made quickly and easily on site.

Figure 4:
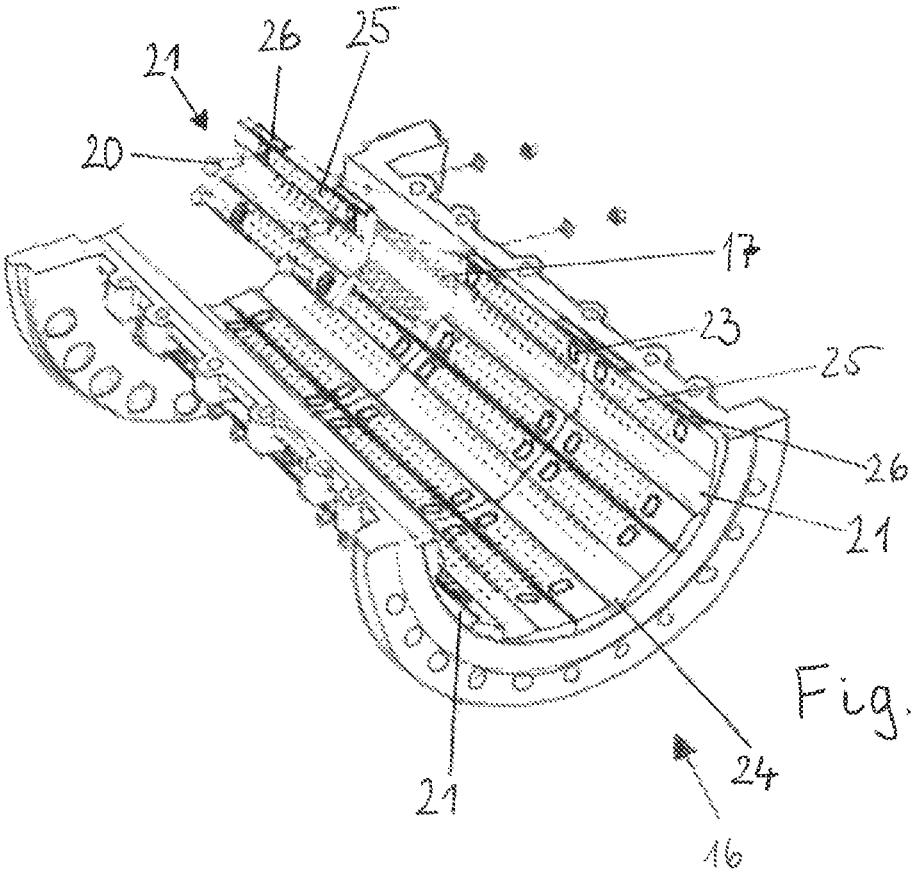
FIG. 4 shows a half shell and illustrates the segments of an embodiment of the disclosed device and the way in which they are secured.

FIG. 4 shows the simple installation using a segment 21 as an example. The figure shows three segments 21 with grooves 24 around the circumference of a bottom half shell 16, resulting in 6 segments over the entire circumference of the housing 10. The holes 25 that overlay the corresponding holes 17 in the half shell 16 are shown in the last segment 21. In addition, the fastening screws 20 and the machined contact surfaces 26 are visible. The segments 21 (and also 22) are not machined on the face ends. The outer surfaces and inner surfaces are not machined either because the grooves 24 can also be cast along with the part.

Figure 5:
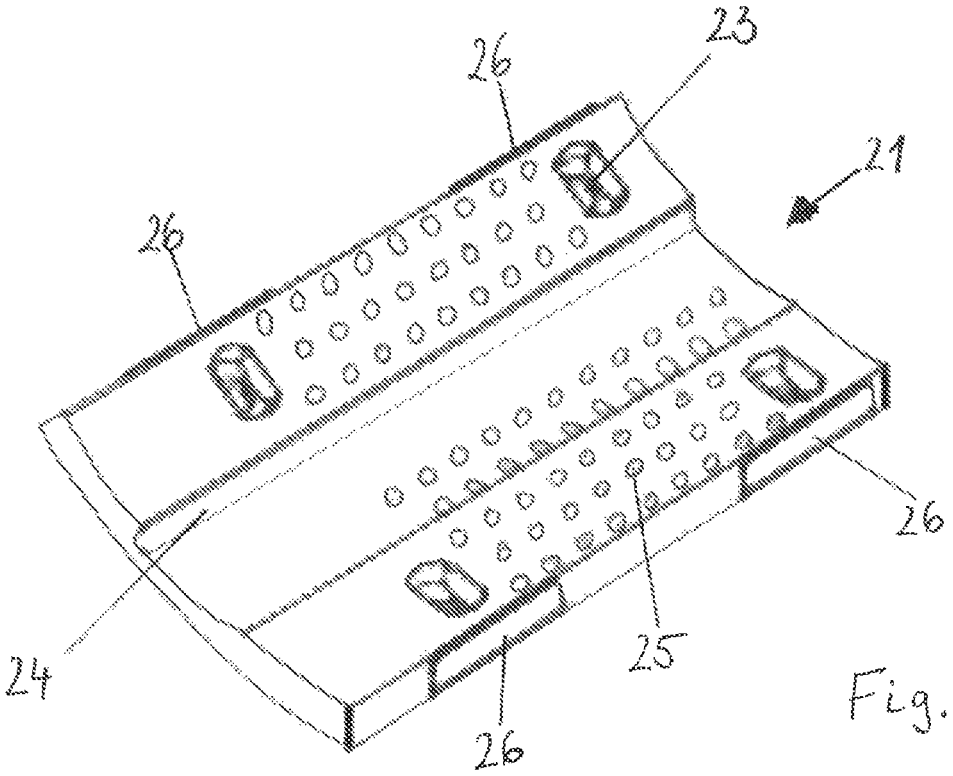
FIG. 5 shows a variant of a segment of an embodiment of the disclosed device.
Figure 6:
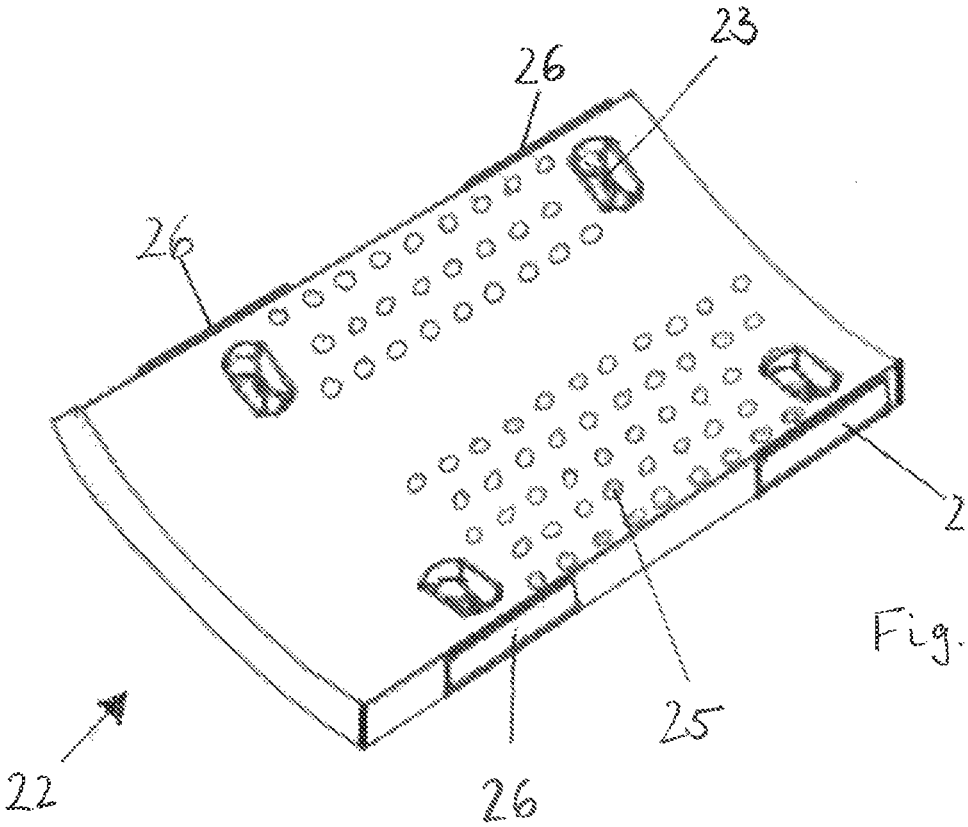
FIG. 6 shows another variant of a segment of an embodiment of the disclosed device.
Figure 7:
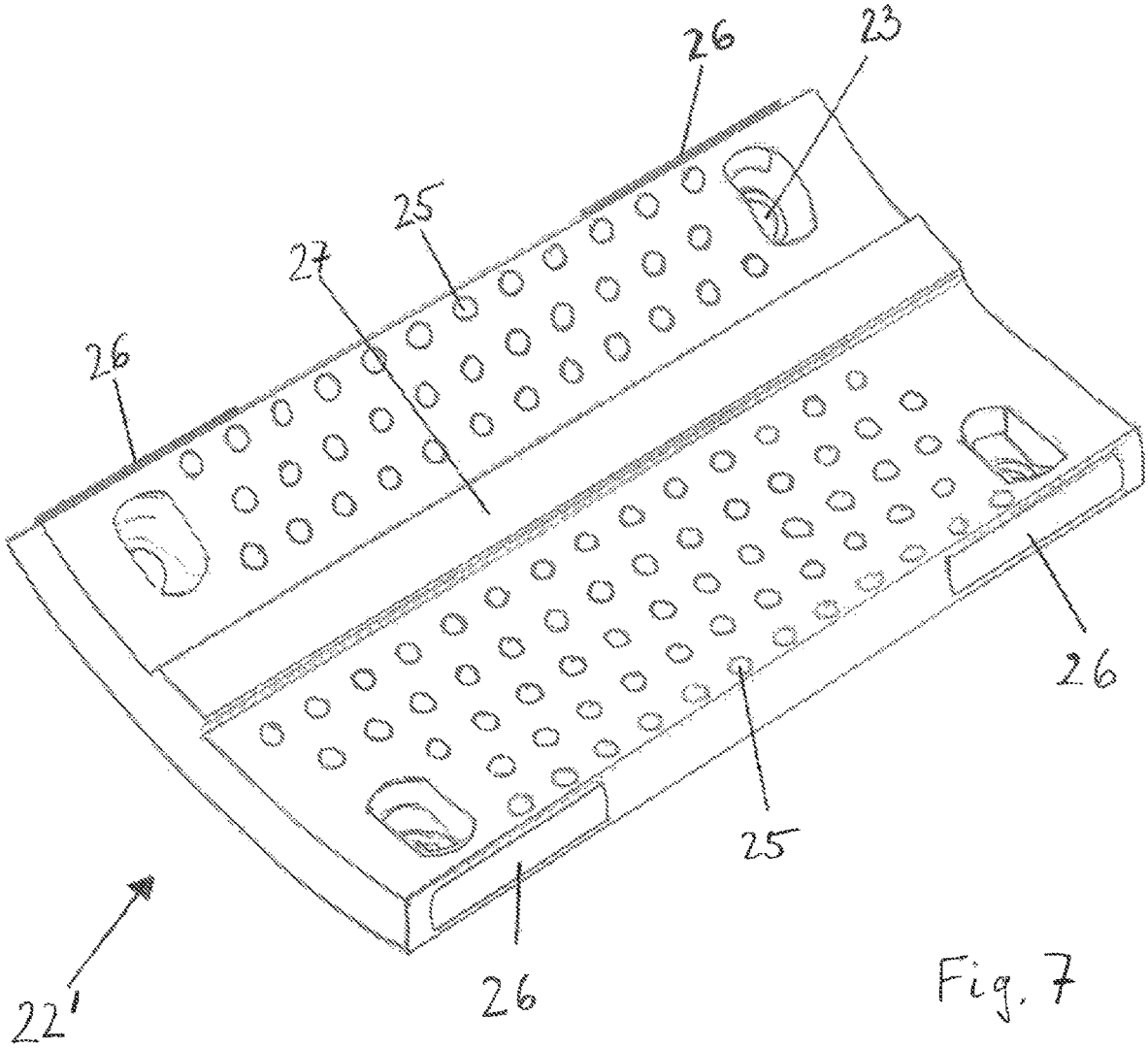
FIG. 7 shows an additional variant of a segment of an embodiment of the disclosed device.

FIGS. 5, 6, and 7 show various embodiments of segments 21, 22, and 22'. They show holes 23 for the fastening screws 20, dewatering holes 25, and contact surfaces 26. The difference between segments 21 and 22 is that segment 21 has a groove 24 in addition that prevents the material from rotating with the shaft and flighting. FIG. 7 contains a variant of a segment 22' in which a strip 27 is provided instead of a groove 24. This strip is also intended to prevent the material from rotating with the shaft and flighting. With a cast or sintered part, this strip can be integrated well and manufactured in one piece. This avoids the disadvantages of strips being screwed on. In addition, there is no need to rework the segment afterwards, e.g. in metal-cutting processes (grinding a groove, drilling holes for screws) so harder materials can be used.

The invention is not limited to examples in the drawings, which show a slightly conical housing. The housing can also be cylindrical, for example, and have cylindrical segments inserted into it. In addition, the housing could comprise three or four parts if the diameters are larger.

The invention claimed is:

1. A device for dewatering feedstock that is pourable or free-flowing by compression, comprising:

a housing (10) with a shell pipe (15, 16) in which a shaft with flights (13) running around its circumference rotates around an axis of rotation, the shell pipe (15, 16) defining an inner surface and having a plurality of holes (17) each having a diameter, an internal pipe comprising segments (21, 22) defining an outer surface and having a plurality of holes (25) each having a diameter, the segments being formed of wear-resistant cast or sintered material, wherein a feedstock is transported through the housing (10) and compressed to yield pressate that is conveyed out through the holes (17) in the shell pipe (15, 16), and wherein the outer surface of the segments (21, 22) rests directly on the inner surface of the shell pipe (15, 16) and each of the holes (25) in the segments align directly with one of the holes (17) in the shell pipe (15, 16), the diameter of the holes (25) in the segments (21, 22) being smaller than the diameter of the holes (17) in the shell pipe (15, 16), and each hole (25) in the segments (21, 22) being assigned to a hole (17) in the shell pipe (15, 16).

2. The device according to claim 1, wherein the shell pipe (15, 16) is cylindrical.

3. The device according to claim 1, wherein the shell pipe (15, 16) is conical.

4. The device according to claim 1, wherein the internal pipe comprises at least four segments (21, 22) in a circumferential direction.

5. The device according to claim 1, wherein the internal pipe comprises at least two segments (21, 22) in a longitudinal direction in accordance with the direction of the axis of rotation.

6. The device according to claim 1, wherein the holes (25) in the segments (21, 22) become wider conically towards the outer surface.

7. The device according to claim 1, wherein the segments (21, 22) each have a groove (24) extending in a longitudinal direction.

8. The device according to claim 1, wherein the segments (21, 22) each has a strip (27) extending in a longitudinal direction.

9. The device according to claim 8, wherein each strip (27) is integrated into a segment (21, 22).

10. A segment (21, 22) of an internal pipe for a device for dewatering feedstock that is pourable or free-flowing, the device having a housing (10) comprising a shell pipe (15, 16) with holes (17) each having a diameter, and in which the internal pipe is located, the segment comprising:

a plurality of holes (25), each of the holes in the segment having a diameter that is smaller than the diameter of the holes in the shell pipe (15, 16), wherein the segment (21, 22) is made of wear-resistant cast or sintered material, and wherein each of the holes in the segment is configured to align directly and overlay one of the holes in the shell pipe.

11. The segment according to claim 10, wherein the segment (21, 22) defines an outer surface and the holes (25) become wider conically towards the outer surface.

12. The segment according to claim 10, comprising a groove (24) extending in a longitudinal direction.

13. The segment according to claim 10, comprising a strip (27) extending in a longitudinal direction.

14. The segment according to claim 13, wherein the strip (27) is integrated into a segment (21, 22).

15. The device according to claim 6, wherein the segments (21, 22) each have a groove (24) extending in a longitudinal direction.

16. The device according to claim 6, wherein the segments (21, 22) each has a strip (27) extending in a longitudinal direction.

17. The device according to claim 3, wherein the holes (25) in the segments (21, 22) become wider conically towards the outer surface.

18. The device according to claim 4, wherein the internal pipe comprises at least six segments (21, 22) in a circumferential direction.

19. The segment according to claim 11, comprising a groove (24) extending in a longitudinal direction.

20. The segment according to claim 11, comprising a strip (27) extending in a longitudinal direction.

* * * * *